United States Patent [19]

Peschel et al.

[11] 4,200,159

[45] Apr. 29, 1980

[54] CUTTER HEAD, DRILL BIT AND SIMILAR DRILLING TOOLS

[75] Inventors: Eberhard Peschel; Hermann Rathkamp; Klaus Katzorke; Rainer Jurgens, all of Celle, Fed. Rep. of Germany

[73] Assignee: Christensen, Inc., Salt Lake City, Utah

[21] Appl. No.: 856,656

[22] Filed: Dec. 2, 1977

[30] Foreign Application Priority Data

Apr. 30, 1977 [DE] Fed. Rep. of Germany ..... 2719330

[51] Int. Cl.[2] ..... E21B 9/36

[52] U.S. Cl. ..... 175/329; 175/410

[58] Field of Search .... 76/108 A, DIG. 12, DIG. 11; 175/329, 330, 410, 411, 409

[56] References Cited

U.S. PATENT DOCUMENTS

| | | | |
|---|---|---|---|
| 1,506,119 | 8/1924 | Hansen | 175/329 X |
| 2,951,683 | 9/1960 | Tilden | 175/413 |
| 3,106,973 | 10/1963 | Christensen | 175/330 |
| 3,127,945 | 4/1964 | Bridwell | 175/329 |
| 3,747,699 | 7/1973 | Fenstra | 175/329 |
| 3,757,878 | 9/1973 | Wilder | 175/329 |
| 3,938,599 | 2/1976 | Horn | 175/329 |
| 4,006,788 | 2/1977 | Garner | 175/330 |
| 4,073,354 | 2/1978 | Rowley | 175/410 X |

FOREIGN PATENT DOCUMENTS

| | | | |
|---|---|---|---|
| 679193 | 12/1964 | Italy | 175/330 |

*Primary Examiner*—William Pate, III

*Attorney, Agent, or Firm*—Subkow and Kriegel

[57] ABSTRACT

Tool for drilling bore holes and earth formations in which a bit body matrix, including tungsten carbide, has a plurality of carriers secured thereto, to each of which a cutting element is secured by soldering, after the body matrix has been produced, to avoid subjecting the diamond material embodied in the cutting element to the high temperatures required to produce the matrix body, which would have deleterious effects on the diamond. Each carrier has great rigidity and is provided with a plane surface confronted by the plane back surface of the cutting element to provide a desired narrow solder gap between the cutting element and carrier of uniform width, into which the solder is deposited to adhere the cutting element and carrier together, with the load being transmitted directly from the cutter element to the rigid carrier.

23 Claims, 19 Drawing Figures

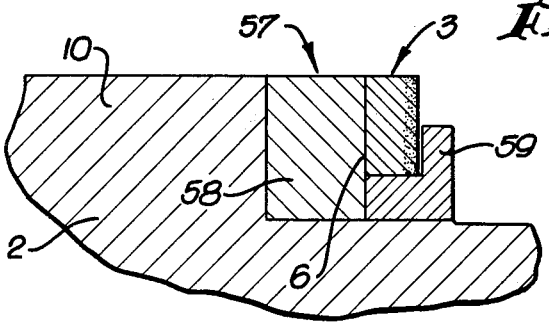
FIG. 10.
FIG. 11.
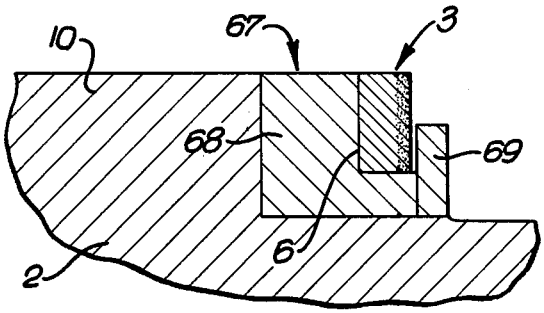
FIG. 12.
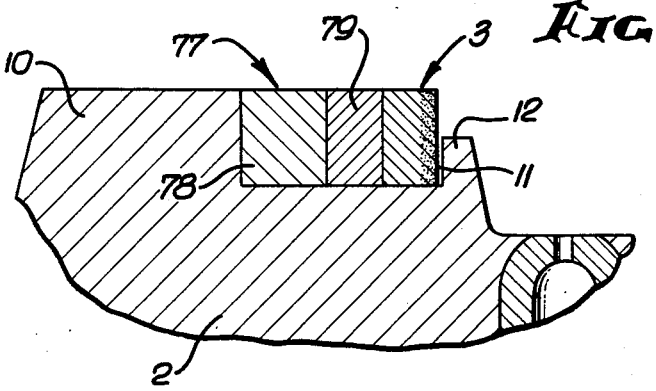

CUTTER HEAD, DRILL BIT AND SIMILAR DRILLING TOOLS

The present invention relates to cutter heads, drill bits or similar drilling tools, particularly for deep well or bore hole drilling. Such drilling tools are used in drilling earth formations in connection with oil and natural gas exploration and production, mining, as well as in the rock and concrete processing fields.

In drilling tools of the above-mentioned type, a basic bit body is first formed by a sintering or infiltration process and integrated to a connection body, after which the cutter elements are hard soldered on carrier surfaces of the basic body. The subsequent application of cutting elements is necessary because of the temperatures encountered in the production of the basic body and its integration with the connection body. The diamond materials of the cutting elements should not be exposed to high temperatures in the interest of preserving their properties.

The basic body is not homogenous due to its structure, which comprises a tungsten carbide matrix and bronze, or the like, which acts as a binder. The matrix has pores which leave much to be desired regarding the planeness of the surfaces to which the cutting elements are soldered. This results in soldering gaps which are too wide and subject to being washed out by the flushing medium used in the drilling operation, or the gaps are of non-uniform width so that the solder filling the soldering gap supports the back portions of the cutting element with irregular rigidity. The matrix-binder composition of the basic body likewise does not have the proper rigidity which is required for uniform support of the back portion of the cutting elements. An irregular rear support of the cutting elements, due to different soldering gap widths, and/or insufficient rigidity of the solder, leads to breaking of the cutting elements under swelling, alternating or sudden loads. Bending moments can be caused by the loads which the support for the cutting elements cannot withstand.

Beginning with the foregoing findings, the invention has for an object the provision of a drilling tool of the above-mentioned type where breaking of the cutting elements under the usual load encountered in drilling operations is avoided, or at least, substantially reduced and limited to cases of unusual load conditions.

For a solution of this problem, the drilling tool of the present invention provides a simple support for the cutting elements by the basic drill bit body, which eliminates to a great extent breaking hazards for the respective cutter elements, due to the rigidity of the carrier to which the cutting element is secured, and the uniformity of the support which it provides to the cutting element. The carrier can be combined in a simple manner with the basic body during production of the latter or after its production, and can easily be provided with a plane supporting surface for a cutting element, which permits the production of optimum soldering gaps between the carrier and the cutting element, that is, narrower soldering gaps of more uniform width.

Preferably, the carrier for a cutting element consists of sintered metal, e.g., tungsten carbide, and the like. However, it is also possible to make the carrier of steel or hard alloy, or to use a ceramic material for the carrier, e.g., silicon nitrite. These carriers can be provided during their manufacture with a plane supporting surface for the cutting element, or this planeness can be obtained by a simple grinding operation.

According to another feature of the invention, the carrier can consist of several parts, where one part forms a unit with the cutting element and can be joined with the other part or parts of the carrier associated with the basic body by welding or cementing. It is also possible to design the diamond studded support of the cutting element as an integral part of the carrier or of a part thereof. While the former embodiment facilitates the production of the carrier and its application or combination with the cutting element, as well as its replacement, the second embodiment has the advantage of eliminating one or more soldering gaps between the carrier and the cutting element or between parts of the carrier, and the further advantage of independence in the shape of the carrier and its adaptation to the form of the cutting element.

Numerous other features and advantages will become apparent from the description and drawings, in which several embodiments of the subject of the application are represented more fully.

Referring to the drawings.

Figure 3:
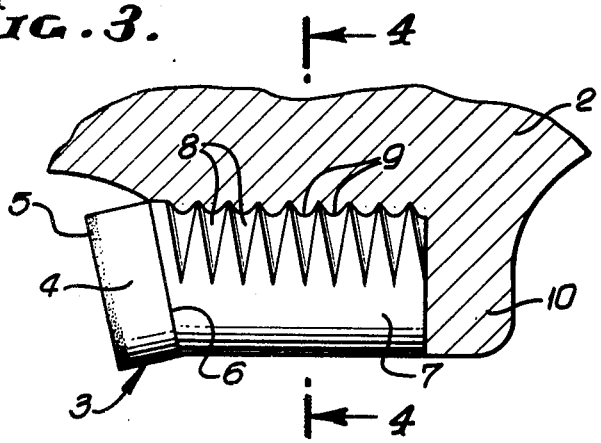
FIG. 3 shows an enlarged section taken along the line 3—3 in FIG. 1.
Figure 4:
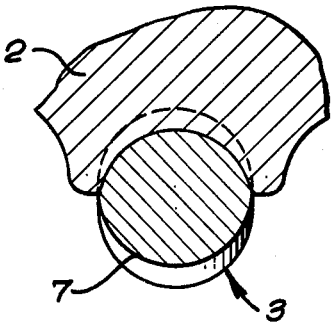
FIG. 4 shows an enlarged section taken along the line 4—4 in FIG. 3.
Figure 5:
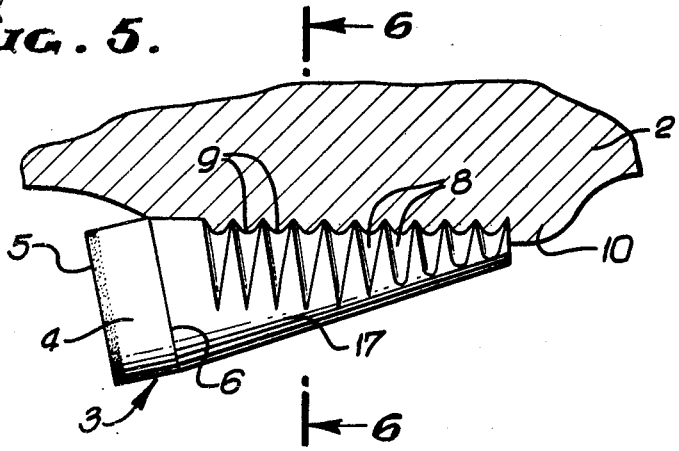
FIG. 5 shows a section representation, similar to FIG. 3, of a modified embodiment.
Figure 6:
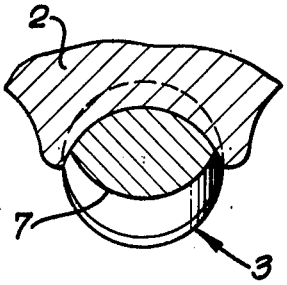
FIG. 6 shows a section taken along the line 6—6 in FIG. 5.
Figure 18:
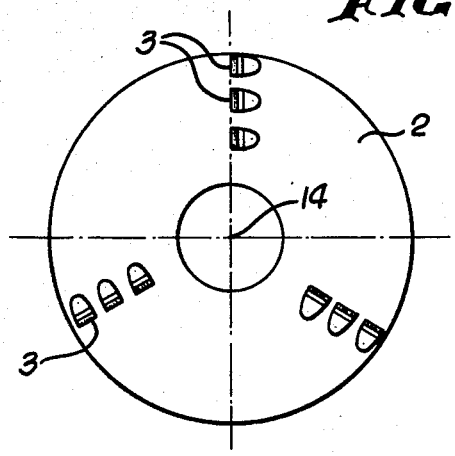
Figure 19:
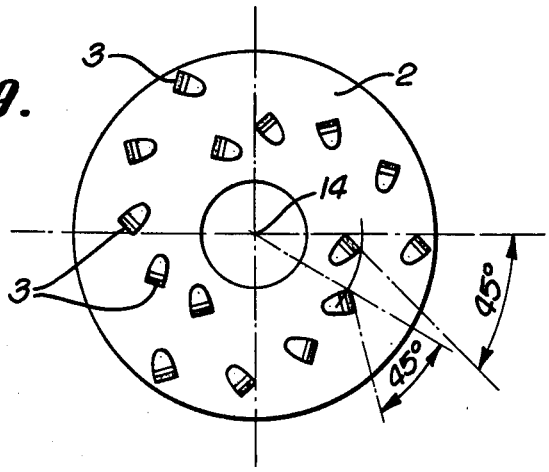

FIGS. 7 to 17, inclusive, show sectional representations, similar to FIGS. 3 and 5, of different modified embodiments according to the invention;

FIGS. 18 and 19 show front views of drill bits to illustrate variations in the arrangements of the cutting elements.

Figure 1:
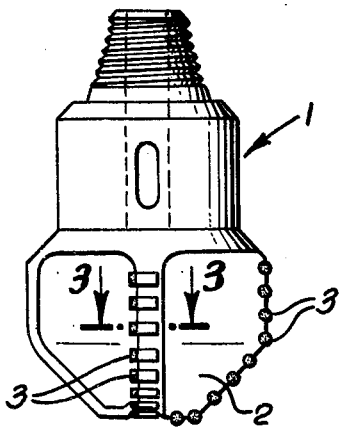
FIG. 1 shows a schematic general side elevation of a drill bit according to the invention.
Figure 2:
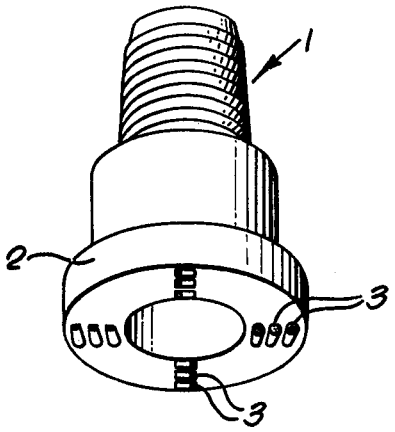
FIG. 2 shows a schematic prospective view of a cutter head according to the invention.

The drill bit represented in FIG. 1, as well as the cutter head shown in FIG. 2, includes a basic structure wherein a basic body 2 of a matrix-binder composition is secured on a connection body 1, cutting members or elements 3 being secured to the matrix-binder combination. These cutting elements 3 consist, in the represented embodiment, of a support 4, in the form of a circular disc of sintered metal, e.g., tungsten carbide, etc., which is provided on a cutting side with a diamond layer or cover 5 of natural or synthetic diamonds, or multicrystalline sintered diamonds.

The cutting elements are each supported on the basic body 2 by a carrier 7 of high rigidity, which can consist of a sintered metal of high density and low porosity. The carrier is designed in the represented embodiment as a separate part, which has a plane supporting bearing surface 6 on which a cutting element 3 is soldered, cemented, or welded, which can be done, for example, by an electron beam or by diffusion welding. The carrier can have different forms, depending on the requirements of the specific case which will be described more fully below.

The carrier 7 represented in FIG. 3 has a substantially cylindrical form and teeth or fins 8 on one connecting side facing the basic body 2 and meshing or locking with the corresponding opposite surface 9 on the basic body 2. The carrier can be supported on its rear side remote from the cutting element 3 by a lug, abutment or other projection 10 of the basic body 2, to insure a sufficient strong and resistant anchoring of the carrier 7 in or on the basic body 2.

The carrier 17 shown in FIG. 5 is similar to that of FIG. 3, but has the basic form of a cone. It is supported substantially only on the connecting side facing the basic body 2 by the fins 8 and surfaces 9, and not at all at the rear side, or at best, by a small abutment 10 of the basic body 2.

The carrier 7, 17, is much thicker (that is, the length is longer) than the thickness of the support 4 of the cutting element 3. The thickness of the support 4 is preferably one-third or more of the diameter of the cutting element, and is so arranged in shape that it is exposed in drilling merely to compressive forces. If bending moments should appear in the carrier 7, 17, the latter can absorb them without breakage, due to its shpae and dimensions.

The carrier 7, 17, as well as the carrier described below can be joined to basic body 2 by soldering, welding, or cementing. In the case of a solder joint, it can be provided with a diffusion-enhancing surface coat, e.g., nickel, copper, or cobalt, which can be applied by physical, chemical, or electrical means. Such a surface coat enhances the flow of the solder in the soldering gap between the contact surfaces 6 of the basic body carrier and the support 4, and improves the production of satisfactory solder joints. The carriers can readily be inserted into the basic body 2 during its production, in which case they are introduced in fixed position into the sintering mold for the basic body 2 and are subsequently combined with the latter during the sintering or infiltration process. In this case also, a surface coat enhances the strength of the joint in the above-mentioned sense and insures a satisfactory flow of the binder into the gap regions between the basic body 2 and the carrier 7, 17. Since the cutting elements are not applied to the carriers at the time of securing the carriers 7, 17 to the basic body 2, the carriers can be secured on the basic body 2 free from any temperature considerations.

The supports 4 of the cutting elements 3 can likewise be provided with a diffusion-enhancing surface coat. The cutting elements can be applied on a carrier 7,17 (as well as on most of the carriers described below) by soldering, welding, or cementing. An epoxide resin is an example of a cement that can be used. A soldered bond between the supporting surface 6 and support 4 is preferred. The surface 6 is made plane during the production of the carrier 7,17 or subsequently by grinding to provide an optimum, that is, a thin and uniform soldering gap between the supporting surface 6 and the corresponding plane back side of suppot 4 of the cutting element 3. The planeness of supporting surface 6 in connection with the rigidity of the carrier insures support for the cutting elements 3, which prevents the appearance bending being moments in the support 4 and thus avoids breaking hazards.

Figure 7:
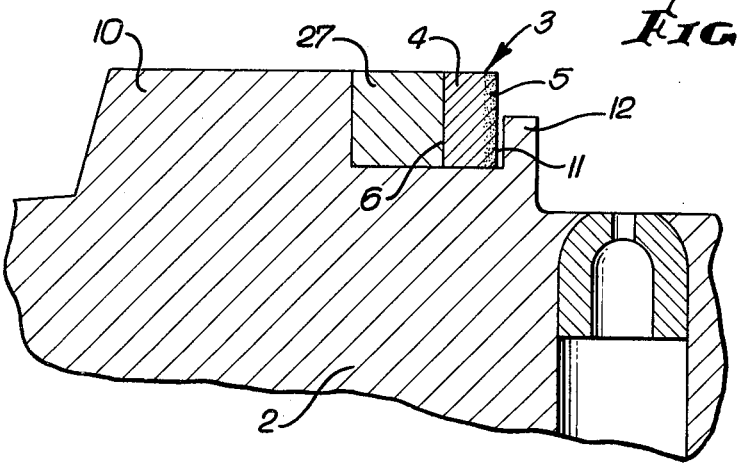

A particularly simple design is shown in FIG. 7, where the carrier 27 has the form of a smooth cylindrical section, that is, a simple geometric form. The rear end of the carrier 27 is connected to the adjacent surface of the basic body 2 by soldering, welding, cementing, or sintering, and is subsequently provided on the supporting surface 6 with the cutting element 3. In this embodiment, cutting element 3 and the carrier 27 are disposed in a pocket 11 of the basic body 2, which is formed, for example, by a groove or recess. Accordingly, carrier 27 is supported in the back by a projection or abutment 10 of the basic body, while a fin 12, or the like, of the basic body 2 partly covers the cutting side of the cutting element 3.

Figure 8:
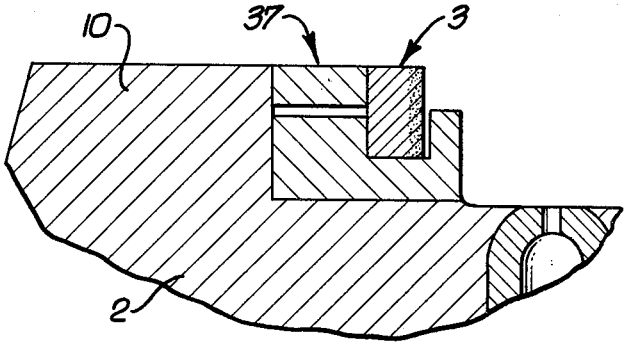

In cases where the arrangement of cutting element 3 is desired in a pocket with partial covering of its cutting side, carrier 37 can be provided with a pocket for the cutting element 3, as shown in FIG. 8. Since the design of a pocket for cutting elements 3 and carrier 37 complicates its shape, it is also possible to build the carrier of several carrier parts.

Figure 9:
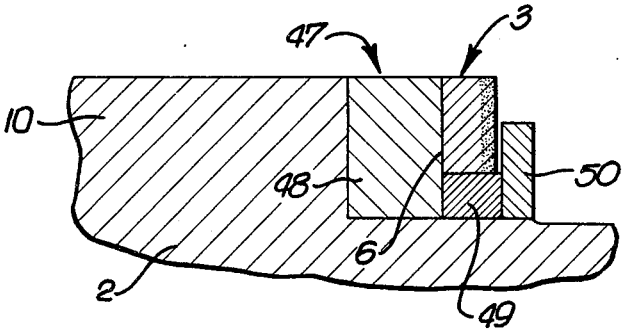
Figure 9A:
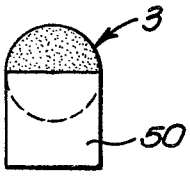

A first embodiment of this type is shown in FIGS. 9, 9a, with a carrier 47 consisting of three parts 48, 49, and 50 of a simple geometric configuration. The carrier parts 48, 49, and 50 are connected with each other along their boundery surfaces, either by cementing, soldering, or by the binder material of the basic body 2, in which case carrier 47 is sintered into the basic body during its manufacture. The supporting surface 6 of carrier parts 48 is then secured to the cutting element 3 in the above-described manner.

Instead of a three-part carrier, FIG. 10 shows an embodiment of a carrier 57 which consists of two parts and comprises a carrier 58, similar to carrier part 48, as well as a carrier part 59 which has the form of the two-carrier parts 49 and 50 of the embodiment according to FIG. 9.

Another embodiment of the invention is illustrated in FIG. 11, in which a carrier 67 consists of two-carrier parts 68 and 69. Carrier part 68 has the form of the combined carrier parts 48 and 49 of the embodiment shown in FIG. 9, while the carrier 69 has the form of carrier part 50 in FIG. 9.

Which form is to be preferred in a specific case results from an optimization of the view points to keep the production costs of the carrier and the number of soldering gaps as low as possible. On the other hand, it must be considered that the part of the carrier in front of the cutting side of the cutting element is subject to wear in the bore hole, and it is, therefore, principally desirable to have for this region an independently replaceable part of the carrier.

FIG. 12 shows an embodiment similar to that in FIG. 7, where the carrier 77 consists of several parts, such as two parts, but carrier part 78 and carrier part 79 are arranged in tandem at the back of the cutting element 3. This design makes it possible to join carrier parts 78 with basic body 2, as described above in connection with the other embodiments, while carrier part 79 is associated with cutting element 3 to form a unit with the latter. Carrier part 79 is connected with cutting element 3 before it is combined with carrier part 77, which has a number of advantages. The combination of carrier part 79 with cutting element 3 independent of a later connection between carriers 79, 78, opens up the possibility of cooling cutting element 3 in a simple manner while it is soldered with carrier part 79, thus effecting the soldered joint without the risk of damaging the diamond cover 5 at a soldering temperature which is substantially higher than a soldering temperature which could be used in the application of an uncooled cutting element 3 on a carrier on the basic body 2. This is of advantage because of the strength of the soldered joint rises with the soldering temperature as one of several strength-determining parameters. A soldered joint between the carrier parts 78, 79 can later be effected at a temperature which does not jeopardize the previous solder joint between cutting element 3 and carrier part 79, and which is higher, due to the shielding effecting of carrier part 79, so that it can be used in the production of a soldered joint between a cutting element 3 and a carrier already joined with basic body 2. Due to a previous combination of carrier part 79 with a cutting element 3, the application and transposition of such a unit is facilitated. At the same time, in cases of great wear, which has already affected large areas of carrier part 79, it is insured that the carrier part 78 remains operatively associated with the basic body 2.

Figure 13:
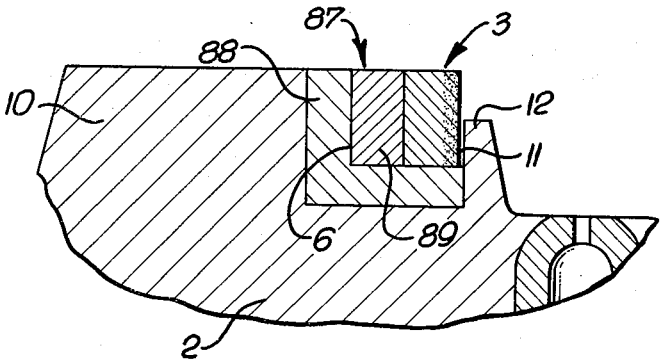
Figure 13A:
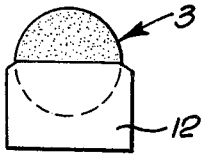

FIGS. 13, 13*a* shows an embodiment similar to that in FIG. 12 where carrier part 87 is again a two-part body, comprising a carrier part 88 with on L-shaped cross section and a carrier part 89 which corresponds to carrier part 79. Carrier part 88 forms not only the rear supporting surface, but at the same time a pocket bottom with its inner longitudinal leg. Here too, however, a subdivision similar to FIGS. 8 to 11 can be provided.

Figure 14:
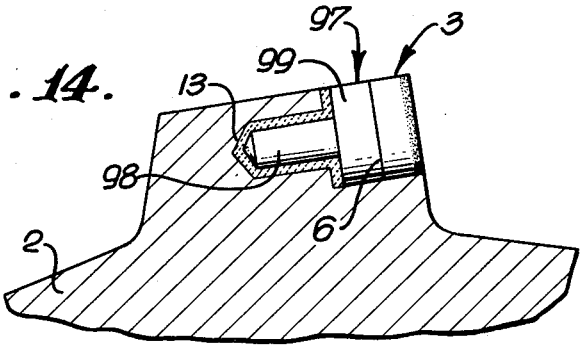

FIG. 14 shows a carrier part 97 which has at the rear a bin-shaped projection 98 having a cylindrical contour and which is received within a corresponding recess 13 in the basic body 2. Carrier 97 has a part 99 which is adapted to the configuration of cutting element 3 and offers to the latter the supporting surface 6. Carrier 97 can be made of one piece, but it can also be a two-part body in which case the separating joint is between the parts 97 and 98. Part 97 forms, in this case, a carrier part in the sense of carrier part 79 or 89, as was described in connection with FIGS. 12 and 13. Such an embodiment permits, among other things, the fixing of pin 98 in the recess 13 of the basic body by thermal or hydraulic shrinkage. It can also be fixed in the recess by soldering or cementing.

Figure 15:
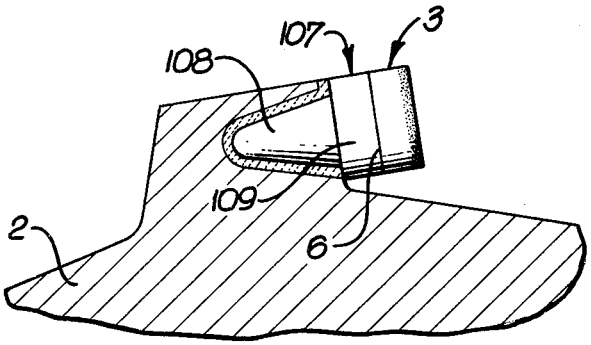

In the embodiment according to FIG. 15, a carrier 107 consists again of a part 109 corresponding to part 99 and of a pin-shape part 108 corresponding to pin 98 in FIG. 14, but which has, in this case, a conical contour.

Figure 16:
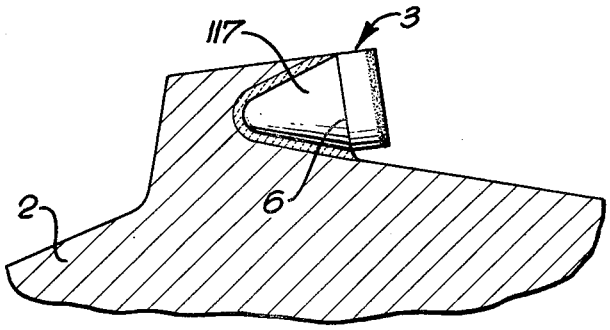

In the embodiment according to FIG. 16, carrier 117 consists of a cone only, which represents its base as a supporting surface 6, which has been widened to the configuration of the back of cutting element 3.

Figure 17:
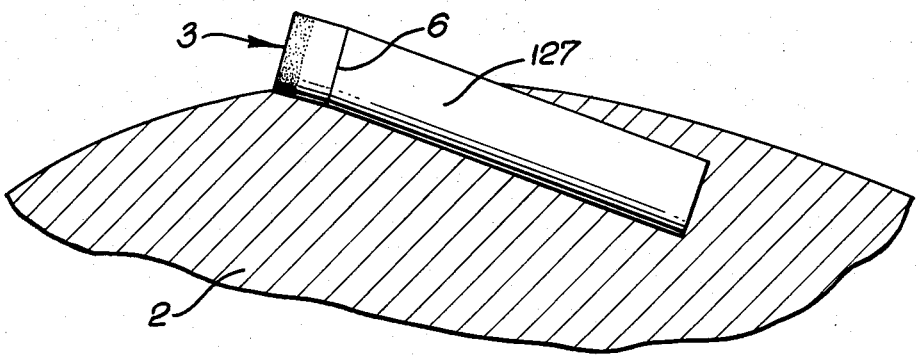

A variation is illustrated in FIG. 17, where carrier 127 has the form of a pin which projects from a recess in basic body 2 and which presents a supporting surface 6 to which the cutting element 3 is secured.

The above-described embodiments generally provide a cutting element 3 to be connected with an associated carrier. This takes into account the fact that cutting elements of the above-described type are at present available only in the illustrative form with disc-shaped supports and a diamond cover 5 provided on the latter. Principally, however, it is also conceivable that the diamond studded support of the cutting element is an integral part of the carrier or of a carrier art.

FIGS. 18 and 19 show cutting elements with different alignments of the cutting planes with regard to the axis of rotation 14 of the drilling tool. In FIG. 18, the cutting faces of the cutting elements lie in radial planes through the rotational axis of the basic body 2. In FIG. 19, the cutting faces lie in planes deviating from the radial planes through the rotational axis. For example, a radial plane through the axis of rotation 14 extending through the innermost edge of a cutter face is disposed at an angle of 45° to the plane in which the cutting face lies. This angle can have any value other than 45°. In addition, instead of lying in the aforementioned planes, the cutting faces of the cutting elements can also be inclined to the bottom of the earth formation to form a positive/-negative angle therewith.

We claim:

1. A drill bit, comprising a connection body, a basic body of a matrix-binder composition secured to said connection body, cutting structures secured to said basic body, the axis of each cutting structure extending transversely of the bit axis, each of said structures comprising a carrier of high rigidity secured to said basic body and being initially a part separate from said basic body, said carrier having a back face abutting said basic body over substantially the entire area of said back face, and a plurality of cutting members each including a support and diamonds on the front face of said support, said cutting member and its support and diamonds being arranged in substantial alignment with each carrier, basic body and back face of said carrier, each of said cutting members having a back face of said support confronting a forward face of said carrier, and means securing substantially the entire area of said back face of said support to said forward face of said carrier.

2. A drill bit as defined in claim 1; each carrier for a cutting member consisting of steel.

3. A drill bit as defined in claim 1; each carrier consisting of a hard alloy.

4. A drill bit as defined in claim 1; each carrier consisting of ceramic material.

5. A drill bit as defined in claim 1; said securing means being selected from a group consisting of soldering, welding, cementing and shrinking.

6. A drill bit as defined in claim 5; said carrier being secured by sintering to said basic body during formation of said basic body by sintering.

7. A drill bit as defined in claim 1; said carrier consisting of multiple parts, one of said parts having said forward face secured to the back face of said cutting member, another of said parts having said rear portion abutting said basic body.

8. A drill bit as defined in claim 1; each cutting element having a thickness of at least one-half the diameter of said cutting element.

9. A drill bit as defined in claim 1; each carrier having a side portion closely adjacent to and extending along said basic body, and means securing said side portion to said basic body.

10. A drill bit as defined in claim 7; said multiple parts of said carrier having smooth adjacent surface for connecting said parts to each other, said forward face of said one part and back face of said cutting member having smooth adjacent surfaces for connecting said one part and cutting member to each other.

11. A drill bit as defined in claim 1; said basic body having a recess in which said carrier is disposed.

12. A drill bit as defined in claim 11; said cutting member being disposed in said recess, a portion of the cutting surface of said cutting member projecting from said recess.

13. A drill bit as defined in claim 1; said carrier having a recess in which said cutting member is disposed.

14. A drill bit as defined in claim 13; said cutting member being disposed in said recess, a portion of the cutting surface of said cutting member projecting from said recess.

15. A drill bit as defined in claim 13; said carrier comprising parts interconnecting each other and defining said recess.

16. A drill bit as defined in claim 1; said basic body having a recess at the rear portion of said carrier, said carrier including a pin projecting into said recess.

17. A drill bit as defined in claim 16; said recess being cylindrical and said pin being cylindrical and conforming to said cylindrical recess.

18. A drill bit as defined in claim 16; said recess being conical and said pin being conical and conforming to said conical recess.

19. A drill bit as defined in claim 16; the forward portion of said carrier projecting from said recess and having said forward face, said cutting member being disposed substantially entirely out of said recess.

20. A drill bit as defined in claim 1; said cutting member having cutting faces disposed in planes deviating from radial planes passing through the axis of rotation of said drilling tool.

21. A drill bit as defined in claim 1; and a surface coat of diffusion-enhancing material on said carriers and cutting members.

22. A drill bit as defined in claim 21; said diffusion-enhancing material being selective from a group consisting of nickle, copper, and cobalt.

23. A drill bit having an axis around which it is rotated during drilling, comprising a connection body, a basic body of a matrix-binder composition secured to said connection body, cutting structures secured to said basic body and having a long axis of each cutting structure extending transversely of the bit axis, each of said structures comprising a carrier of higher rigidity than the rigidity of said basic body secured to said basic body and being initially a part separate from said basic body, said carrier having a back face abutting said basic body over substantially the entire area of said back face, and a plurality of cutting members each including a support and diamonds on the front face of said support, said cutting member and its support and diamonds being arranged in substantial alignment with each carrier, basic body and back face of said carrier, each of said cutting members having a back face of said support confronting a forward face of said carrier, and means securing substantially the entire area of said back face of said support to said forward face of said carrier, each of said front faces being transverse to the axis of its cutting structure and facing in the direction in which said cutting member is cutting.

* * * * *